United States Patent [19]

Plumadore

[11] Patent Number: 4,526,850

[45] Date of Patent: Jul. 2, 1985

[54] DIODE BIAS ELECTROPHOTOGRAPHIC TONING SYSTEM AND METHOD

[75] Inventor: John D. Plumadore, Westfield, Mass.

[73] Assignee: Photon Chroma, Inc., Westfield, Mass.

[21] Appl. No.: 508,459

[22] Filed: Jun. 27, 1983

[51] Int. Cl.[3] ..... G03G 13/06; G03G 15/06

[52] U.S. Cl. ..... 430/103; 118/647; 355/3 DD; 355/14 EH; 355/14 D

[58] Field of Search ..... 430/103; 118/647, 650, 118/651; 355/3 DD, 10, 14 D, 14 EH

[56] References Cited

U.S. PATENT DOCUMENTS

Re. 31,371 9/1983 Kuroishi et al. ..... 355/3 DD X

*Primary Examiner*—Evan K. Lawrence

*Attorney, Agent, or Firm*—Schwartz & Weinrieb

[57] ABSTRACT

The present invention is a diode bias toning system and method for use in and with electrophotographic copying machines and the like, and provides a significant improvement over "floating" and "hard-wired" toning systems to provide a user with the benefit of self-compensation or self-adjustment sensitometry, while allowing better control of large density percentage images and providing a simple and practical means and method which yield the satisfactory inherent results or advantages of a "hard-wired" system. The employment of a single diode means connected between a development electrode and a variable high-voltage D.C. power supply, so as to prevent the passage of current between the development electrode and the supply means, thereby facilitates the usage of a single high-voltage D.C. power supply to supply both the corona charging and toning biasing functions of an electrophotographic copying machine or system.

20 Claims, 3 Drawing Figures

DIODE BIAS ELECTROPHOTOGRAPHIC TONING SYSTEM AND METHOD

FIELD OF THE INVENTION

The present invention relates generally to an electrophotographic toning system and method for use in, or with, electrophotographic copying machines, and provides a significant improvement thereover.

BACKGROUND OF THE INVENTION

In general, two types of electrophotographic toning systems exist, which may be described and termed, in an electrical sense, as "floating" and "hard-wired" or "biased" toning systems, each having its particular advantages, and each having been used in known commercial systems and machines.

Technically, a hard-wired system offers the most control over the photographic process since it satisfies the requirements of electron movement within the image copying system. In practice, however, commercial systems are often based upon some form of a "floating" system since floating systems tend to produce quality images from several different types of image mediums, each of which have distinct critical parameters as to the electrophotographic processing or copying of the same.

Floating systems may be classified into three main categories, which are as follows:

(1) No electrode-edge effect;

(2) Floating conducting layers; and (3) Floating electrode.

To the knowledge of the present inventor, the floating electrode type system was first used within a specific electrophotographic copying machine in order to reduce the "dark-banding" effect when a charging and toning operation was accomplished simultaneously, and when paper exhibiting poor surface conductivity was being employed, such system later being refined in its use in other electrophotographic machines.

In most systems known to the inventor, "floating" systems were used to correct a variety of problems of image quality copying upon various image media while still providing the users of such systems the additional benefits of good "fill-in" and automatic exposure control capability. One problem with a "floating" system used within a known system is its inability to correctly render images from an image medium having a high percentage of black areas, such as, for example, a photograph, which appear as being "washed out".

Such "floating" systems are usually referred to in the field of the invention as systems having floating sensitometry, which systems have difficulty in reproducing images having characteristically large dense areas, such as, for example, the above-mentioned photographs, and some types of forms, or the like. This difficulty arises from the fact that "floating" sensitometry systems always tend to deposit the same amount of toner upon the copy medium for the entire copy, and since such large dense areas require more toner than the remaining areas of the copy, this characteristic of the "floating" systems tends to reproduce such dense areas in a weak or "washed-out" manner since the toner is averaged or equally distributed over a large area. Such systems have also been described as having a self-adjusting sensitometry, and are exemplified by the inventor's own U.S. Pat. No. 3,964,436.

As stated above, the present invention provides a significant improvement over the above-disclosed types of systems, and provides the user with the benefit of self-compensating or self-adjusting sensitometry. The present invention also provides better control of large density percentage images, and a simple and practical method and means for achieving the satisfactory inherent results of a "hard-wired" system.

In order to fully understand the above-described significant improvement of the present invention, it is necessary to understand how toning takes place in the above-identified types of electrophotographic toning systems.

With respect to "floating" systems, when toner is deposited upon an electrophotographically charged pattern image, an equal and opposite polarity charge is deposited upon, or supplied to, the development electrode. This opposite charge causes "floating" systems to have self-control or be self-adjusting. For example, within a known unit having an external capacitance which is very small, the capacitance dictates a 10% criteria for the size of the electrode, and as toning occurs, the deposition of the aforenoted opposite polarity charge causes a charging of this small capacitance so that after a small toner deposition, and thus a small charge deposition, the voltage upon such electrode reaches that of the maximum charged area upon the image, whereupon toning ceases since there is no longer any field to cause particle migration.

Accordingly, if large areas are being toned, then this occurs before a high-density is reached, and thus, a light image results therefrom. This is further complicated by the fact that the low-charge areas are also part of such external capacitance and further tend to modify the amount of toning which occurs.

On the other hand, within "hard-wired" systems, the voltage level is maintained, and toning thus continues, so as to produce high densities regardless of the size of the dense area being toned. However, in systems and applications where for best results, a variable voltage level is desired, the "hard-wired" system produces variable and undesirable results. Thus, the present inventor has found and duly noted that the field of electrophotographic copying machines and systems has a need for a means and a method for an electrophotographic toning system which yields the benefits of both "floating" and "hard-wired" toning systems. The presently disclosed invention satisfies this and other needs within the field of electrophotographic copying machines and systems thereof.

The closest prior art known to the inventor is that disclosed within U.S. Pat. No. 4,045,217, assigned to RICOH COMPANY, LTD., wherein it is noted that it has previously been proposed to use a constant voltage diode connected between a developing electrode and the ground, and which has a characteristic breakdown voltage slightly exceeding the maximum value of the residual potential within the background portion of the image. In distinct contrast thereto, the present invention, as disclosed hereinbelow, uses a back or reverse-biased diode means which is connected between a developing electrode means and a high voltage D.C. power supply means which is employed as the bias voltage supply source for such reverse-biased diode means. Furthermore, although the present invention does use such reverse-biased diode means as a constant voltage diode, the bias voltage level being easily variable by varying the voltage level of the bias voltage supply source, contrary to the abovementioned disclosure of U.S. Pat. No. 4,045,217, the diode means of the present invention is a non-zener diode which is not directly connected between the developing electrode and ground, and which allows the usage of voltages beyond those levels normally capable of being accommodated by commercially available zener diodes. In this regard, the types of films useable with the presently disclosed invention require voltages on the approximate order of 800 volts. Even further, the diode means of the instant invention does not have a characteristic breakdown voltage slightly exceeding the maximum value of the residual potential within the background portion of the image.

OBJECTIVES OF THE INVENTION

With the present invention, the above-recited difficulties of a "floating" toning system are eliminated, and the advantages and benefits of both "floating" and "hard-wired" toning systems are obtained.

A primary object of the invention is to provide a toning system which for images, such as normal business documents, that is, a white sheet of paper with dark type thereon, the present invention has a self-adjusting sensitometry which compensates for differences in paper background color, photoconductor speed, charging characteristics, and other exposure effects, while having the capability of producing or yielding quality images from photographs or other image media having large dense areas.

Another object of the present invention is to provide a toning system circuit means which is relatively simple in its component construction, wherein a single, non-zener diode means is connected with and between a development electrode means and a variable high-voltage D.C. power supply means used for both corona charging and toning biasing functions of an electrophotographic copying machine or system, such diode means being connected with and between the development electrode and the power supply so as to prevent the passage of current from the power supply to the development electrode.

A further object of the present invention is to provide improved image characteristics of the final reproduced image, and to further provide a toning circuit or system arrangement such that for electrophotographic machines or systems where charging and toning occur at different times, the high voltage power supply means used for a corona charging function can also be used for providing the bias control voltage for the diode of the invention, and thus, lower the cost of the total system by allowing the usage of a variable single high-voltage power supply source instead of providing separate power supply sources, one of which is used to supply the corona charging voltage and the other of which is utilized to supply the toning function or operation.

A further object of the present invention is to provide an automatic method or means whereby images having large, dense areas can be reproduced in final image form with much greater density than affordable by conventional "floating" systems, and, in addition to this automatic compensation feature of the present invention, the instant invention embodies a low cost, expedient for switching from "floating" sensitometry to "hard-wired" electrode sensitometry without the need for expensive switching equipment or devices, and accordingly, the use of a single variable power supply means for both corona charging and bias toning functions is afforded.

In addition to those objects of the present invention noted hereinabove, the present invention further facilitates a rapid adjustment of the toning bias voltage level, in order to compensate for different copy characteristics, without the requirement for various feed-back switching techniques, and provides an approach and/or system having several control advantages over systems employing corona discharge as a voltage source, since the present system is easier to control and does not require the usage of a zener diode or other device to allow discharge.

BRIEF DESCRIPTION OF THE DRAWINGS

Various other objects, features, and attendant advantages of the present invention will be more fully appreciated as the same becomes better understood from the following detailed description when considered in connection with the accompanying drawings, wherein.

DETAILED DESCRIPTION OF THE ILLUSTRATED EMBODIMENTS

Figure 1:
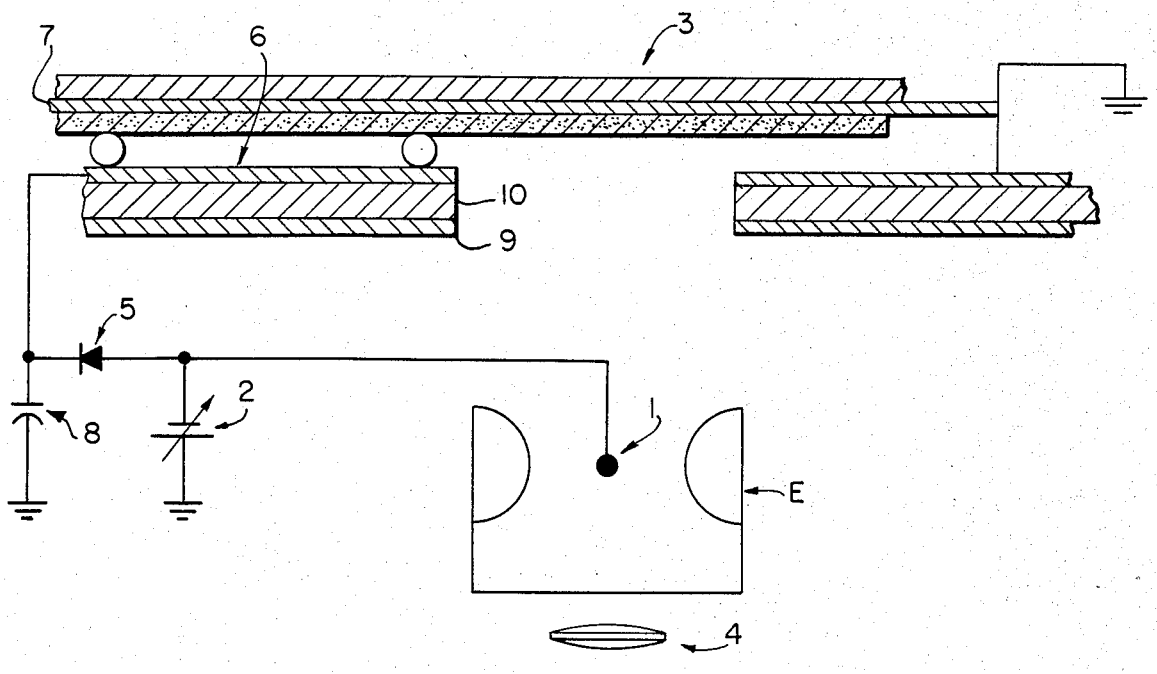
FIG. 1 shows an embodiment of the system of the present invention as employed within a PHOTON CHROMA tri-station micrographic system, in which embodiment a single power supply means is utilized as a source of supply voltage for both corona charging and toning via a diode bias means.
Figure 2:
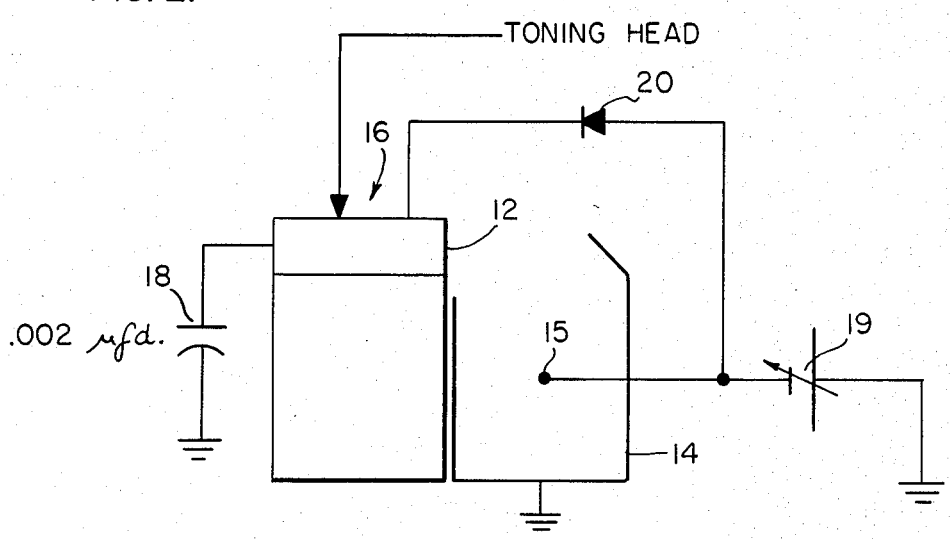
FIG. 2 depicts another similar embodiment of the system of the present invention as employed and used within a PHOTON CHROMA AV-35 series camera processor.

Referring now to the drawings, and more particularly to FIGS. 1 and 2 thereof, for the purpose of simplicity, it is noted that the present invention system has been illustrated in connection with a negative charging system, although it should be realized that the present invention system is likewise operative if all of the depicted polarities and polarity sensitive devices are reversed.

Furthermore, an example of a suitable single diode means employed in the present invention is a diode device bearing manufacturer's identification UNITRODE LS-80 having an 8 KV rating, and, a high voltage D.C. power supply means suitable for use in the present invention may be of the low impedance type having a range or rating of 400 v–7 Kv, which may have a manually variable input voltage control means.

With respect to that shown in FIG. 1, during a corona charging operation of high voltage D.C. power supply means 2, such will provide a charging voltage between 4.5 Kv and 8.0 Kv to corona wire 1, which is normal for such charging devices, a charge-shaping electrode means E being operatively associated therewith. A photoconductive film 3, having insulating means 7, is charged by corona wire 1 and the power supply 2, and an image lens 4 is provided for exposure of the film 3. As depicted in FIG. 1, power supply means 2 has its negative side connected to both corona wire 1 and the anode of a single bias diode means 5, while the positive side of power supply means 2 is connected to ground. The cathode of single bias diode means 5 is connected to a capacitor 8 and a development electrode means 6. Elements 9 and 10 are part of a charging mask structure much like that disclosed within the present inventor's issued U.S. Pat. No. 3,991,311. The depicted capacitor 8 connected between ground, the cathode side of diode 5, and development electrode 6, depicts and represents a small external capacitance to ground of development electrode 6, which capacitance 8, to be assumed for the purpose of this discussion, is to be so small that it does not play an important role in the toning development electrode 6 voltage operation.

Since power supply 2 is used in a voltage range between 4.5 Kv and 8.0 Kv, and since single diode means 5 is of the high voltage type, as set forth hereinabove, and is connected as shown so that the charge from power supply 2 cannot pass through to the development electrode 6, there will be no effect on the development electrode 6 during such charging step or function. If diode 5 was not connected in this manner, then the voltage supply from power supply 2 would cause arcing to the film 3 during a charging operation. Photoconductive film 3 is of course imaged through means of lens 4 by means of a light source, not shown, so as to produce an electrostatic charge pattern via a process well-known in the art of electrophotography.

In the embodiment of the invention illustrated in FIG. 1, after such charging and exposure operations, the film is advanced one frame to a toning station in front of development electrode 6. During the toning operational step, the voltage of power supply 2 is lowered to a lower voltage which will be referred to herein as the bias voltage. While the level of such bias voltage is dependent upon many factors, a typical exemplary level is 800 volts, which is a requirement of the specific type of film currently useable within the system of the present invention. The bias voltage level is generally set slightly, for example, 50–100 volts, above the background voltage level after the photoconductor has been exposed. With all useful photoconductors, this voltage is low enough so as to eliminate corona discharge through wire 1 and, therefore, the charging station will be inactive during the toning function or step of operation.

When a charge pattern image is in place, an electrodeveloper or toner medium is introduced into the gap defined between film 3 and development electrode 6. The toner medium useable in this system may be of the positive type, and therefore, will be attracted to the negative portions of the image, thereby creating a positive image. In this regard, a positive toner is one having an optically dense element which is positively charged, and a usually clear element or carrier of equal and opposite, that is, negative, charge, whereby toning is the result of the separation of these two elements so as to form the image. When toner enters the aforenoted gap between the film and electrode 6, the voltage upon development electrode 6 is raised to a level equal to the average voltage upon film 3. In reality, this voltage is usually slightly less than the average voltage upon film 3 since there is always some small external capacitance-to-ground associated with electrode 6, such capacitance, as noted hereinabove, being assumed to be so small as to not play an important role in the toning electrode voltage.

Since, in conventional "floating" systems, and for the purpose of this discussion, where the external capacitances are so small that the induced voltage upon the development electrode is essentially the same as the average voltage upon the film, all areas of the film which are more negative than the average voltage will tend to tone, while those areas of the film which are less negative or more positive than the average voltage will tend not to tone, or in fact, detone. If the dense image area is relatively or proportionally large, that is, there are large areas of the undischarged photoconductor surface, then the average voltage upon the film will be highly negative, and the resultant image will therefore appear weak. As toning progresses, the deposition of charge upon the development electrode and the film surface result in a complex series of electrical changes which causes accurate analysis to be rather difficult. Generally, however, as toning progresses, this deposition of charge results in a build-up of voltage upon the development electrode which effectively causes toning to cease. While a full understanding of the toning process under floating conditions must take into account what occurs during the entire toning process, for purposes of this discussion, analysis of the initial electrical state is adequate to show the advantages and effects of a conventional "floating" system. In fact, for some systems, wherein the toning time is short, this analysis is a reasonably accurate evaluation.

In the diode bias voltage toning system of the present invention, the bias voltage from power supply 2, during a toning operation, is ideally set just slightly above the normal average voltage determined for an average business document. As for films currently in use, this bias voltage level is approximately 900 volts and the image is normally discharged in the background areas to a level of approximately 800 volts. This 100 volt differential allows for a variation in the background voltage of up to 100 volts without producing density in the background areas, which is the objective of "floating" systems. In initial stages of toning, the voltage induced upon the development electrode is the average voltage upon the imaged film, or the voltage of the power supply connected to the diode, whichever is lower. Thus, if the image areas have the background of a standard business document, then there are no substantial initial differences between the conventional "floating" system and the diode bias system of the present invention. The differences become clear, however, when the image area of high density is relatively or proportionally large, that is, there are large areas of the undischarged photoconductor surface, and therefore, the average voltage upon the film rises above 900 volts. By means of the present invention, the diode clamps or restricts the development electrode voltage to the 900 volt level, or in other words, to a level below that of the average voltage level upon the surface of the film. As a result, toning of the large dense areas is significantly improved relative to conventional "floating" toning systems.

As toning progresses, the deposition of charge upon the development electrode 6 is allowed to bleed-off by means of diode 5, and thus, the voltage level upon the development electrode 6 is maintained at the level of the high voltage power supply 2. Thus, toning is allowed to progress normally in these areas, which is in contrast to the operation of conventional "floating" systems wherein such negative charges increase the voltage upon the development electrode thereby further inhibiting toning. In this regard, further reference to that noted hereinbelow in connection with FIG. 2, and in particular, the discussion provided hereinbelow in connection with the disclosure of FIG. 3, will by reference thereto, further facilitate an appreciation and understanding of the operation of the present invention.

FIG. 2 shows the single diode bias toning system or circuit of the present invention as it is used and employed within a PHOTON CHROMA AV-35 series camera processor machine. In this case, a primary objective was to render practical the use of a single high voltage D.C. power supply means for both the charging and toning functions, since a slide card utilized within this system renders a "floating" image impractical.

A basic difference of that depicted in FIG. 2 from that shown in FIG. 1 is that, in the system of FIG. 2, the image is scanned when toned.

In the depicted embodiment of FIG. 2, a slide card, not shown, is charged by corona wire 15, defined by a shield 14, with a high voltage, i.e., 6 Kv, as supplied from high voltage D.C. power supply means 19, such voltage further being supplied to development electrode 12, which charges up capacitor 18. The level of this charge voltage is controlled by the spacing of the grounded corona shield 14 from the development electrode 12 so that the voltage on the development electrode 12 approximates the voltage on the charged film, such being accomplished for reasons described in pending U.S. patent application Ser. No. 06/144,782, which is to allow the film to pass over the development electrode in a charged state without being attracted to it, or having residual toner attracted to the film.

The charged film then stops just beyond development station 16 where it is exposed by means not shown. During this exposure operation, the voltage of power supply means 19 is lowered to a level which would be typical if the depicted system were conventionally biased.

As further shown in FIG. 2, a single diode 20 is connected directly between the negative side of high voltage D.C. power supply means 19 and development electrode 12, in the same manner as that shown in FIG. 1. As stated hereinabove, such connection of diode means 20 functions such that charges from power supply 19 cannot pass through or reach development electrode 12; and, without such connection of diode 20, the voltage on development electrode 12 would be so great that it would cause arcing to the film which passes over it.

After the completion of an exposure operation, toner is presented to development electrode 12 and the film is transported back over development electrode 12. The pre-charged capacitor 18 serves to ensure that the initial voltage on the development electrode is high enough and at an adequate level so as to produce the desired image effects. Without such capacitor 18, the initial area of the slide becomes dark and part of the toning would take place without the film being in front it. Also, the end of the film would also become dark because a conductive strip, which is part of the film construction, would cause a lower than desired average voltage to be present at the end of the slide.

The relatively high capacity of the 0.002 microfarad capacitor 18 keeps the voltage on development electrode 12 from changing too rapidly as a result of the scanned changing in the image or a non-image area passing over the development electrode.

Further with regard to scanning systems, such as that depicted in FIG. 2, there exists a possibility where it would be desirable in having the characteristics of a floating system operation. An example of such a system would be an office copier system, or a roll microfilming system, where, in order to maintain clean background, automatic control sensitometr is a desired or attractive expedient. In this case, the capacity to external ground should be as small as possible, since relatively rapid changes as a result of image or photoconductor condition would be desirable. Also in this case, capacitor 18 would not be a discrete component but would represent an effective external capacitance. Even further in this case, if the bias diode toning system of the invention is employed in such system, such may require the use of a separate power supply for the toning operation, which supply would be set slightly higher than the anticipated highlight areas, in the same manner as for a single frame system which has been described hereinabove with respect to FIG. 1. In this instance, the invention would function in a similar manner; and, in normal images, the floating area below the bias voltage would compensate for changes in copy, photoconductor, and illumination; but, as soon as the average voltage was exceeded, the excess voltage would be bled off through diode 20 and power supply 19.

Figure 3:
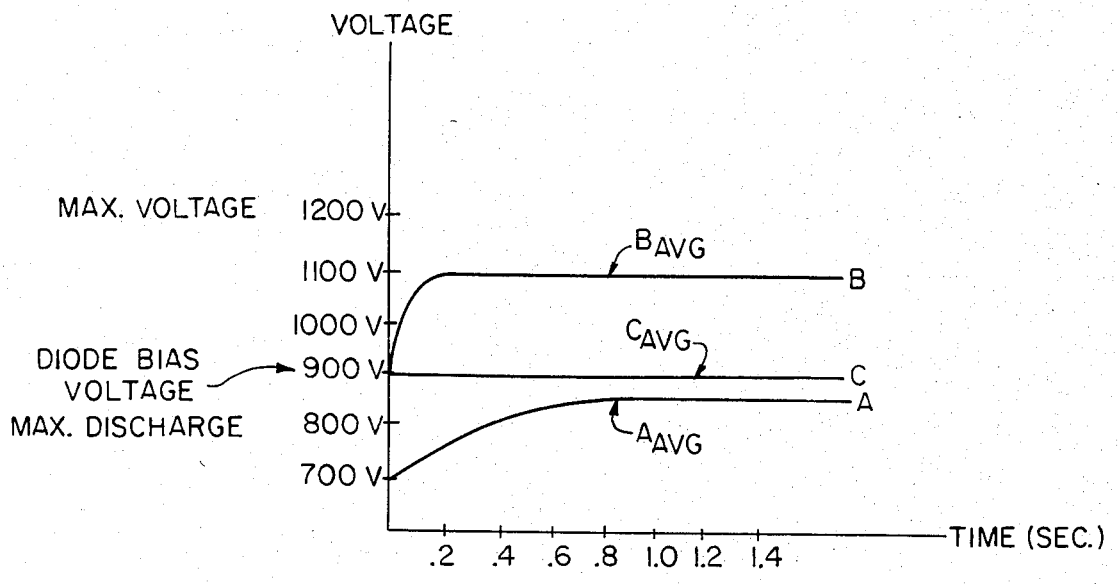
FIG. 3 provides a graphical illustration of the voltage versus time operation of the reverse-biased diode of the system of the present invention and, in essence, depicts a representative operation of the present diode bias toning system in three examples of application, which will be discussed in detail hereinafter.

FIG. 3 has been provided in order to present a graphical depiction of the operation of the present diode bias toning system, and to provide a comparison of such operation of the invention with the operations of a conventional floating system and another to be described hereinafter.

Curve A graphically depicts the voltage as a function of time of a normal business document being toned in a floating system. It is duly noted thereby that Curve A starts slightly below the average voltage level $A_{avg.}$ and slowly flattens out up to the depicted average voltage level $A_{avg.}$ during the toning process time.

Curve B provides a graphical depiction of a toning operation for an image where there is a significant amount of dense area and, therefore, the average voltage level $B_{avg.}$ is high or 1100 volts. It is further noted that Curve B starts out also below its average voltage level $B_{avg.}$, but very quickly attains its average voltage level. Since this average voltage level is so high, the forces on the toner are greatly minimized and resultant density is greatly reduced in the large dense areas. Also, the light areas, which might contain details, being initially less negative than the development electrode, receive no toning, the result of which is an image which appears overexposed.

Curve C depicts the voltage operation when an image referred to or represented by Curve B is toned in the present invention diode bias toning system set at 900 volts. By comparing Curve C to Curve B, it is clearly noted that that shown in Curve C represents a significant improvement in the density obtained in these large areas because the voltage differential is higher, and the beforementioned light areas, which may still be somewhat slightly over-lightened, are reproduced in an improved fashion, since the voltage differential above them is not as great.

The foregoing discussion of that depicted in FIG. 3 in consideration with that presented hereinabove in the "Background of the Invention" and other passages of this specification should provide a clear and fuller understanding of the present invention.

Accordingly, in systems where a step function is used for electrostatic imaging, such as that used in Photon Chroma's AV-35 series of instant slide systems and updatable microsystems, usually two systems for high voltage are required; one for the corona function and one for the bias function. The present invention allows the use of a single power supply means and provides a unique and novel circuit which allows the same control functions to be accomplished as that done by two power supply systems, at a significantly lower cost.

Furthermore, the present invention provides a significant improvement over the above-described types of electrophotographic toning systems and provides the user with the benefit of self-compensation or self-adjusting sensitometry, while allowing better control of large density percentage images and providing a simple and practical method and means which yields the satisfactory inherent results of a hard wired system.

With further regard to that presented hereinabove, the single diode means of the present invention is biased with a power supply voltage of the same polarity as the charge on the image member. The bias voltage of the single diode means may be greater than the voltage on the most highly discharged area of an image area being toned.

The single high voltage D.C. power supply means of the present invention operates to supply bias voltage to the single diode means, as set forth above, and is also operable to charge an image surface of an image member, and may even further operate to supply other functions of an electrophotographic copying machine such as a transfer toner function or an image erase function.

With the employment of the presently disclosed bias diode controlled toning system, the capacitance of a development electrode means may be controlled to a value which produces desired image characteristics. An effective capacitor means, such as capacitor 8 of FIG. 1, may be biased to a voltage of the same polarity voltage as the diode bias voltage of the toning system of the present invention; and, an effective capacitance of a development electrode means can be of the same polarity, but different voltage than the diode bias voltage of the toning system of the present invention.

The specific diode and power supply components and ratings thereof, set forth above, are examples of operative embodiments only and these values could change depending upon the particular application of the present invention.

As this invention may be embodied in several forms without departing from the spirit or essential characteristics thereof, the present embodiments are, therefore, illustrative and not restrictive since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A bias diode controlling toning system for electrophotographic materials and operable with an electrophotographic copying machine and the like wherein charging and toning take place at different times, comprising, in combination:

corona-charging means;

a development electrode means;

a single variably adjustable voltage D.C. power supply means connected with said development electrode means and said corona-charging means for supplying a first predetermined corona-charging voltage level and a second predetermined toning voltage level; and a single diode means connected in circuit with and between said development electrode means and said power supply means in such a manner for preventing the passage of current from said power supply means to said development electrode means when said power supply means is set at said first predetermined corona-charging voltage level so as to prohibit arcing between said development electrode means and said electrophotographic material, and for permitting the passage of current from said development electrode means to said power supply means when said power supply means is set at said second predetermined toning voltage level so as to permit said development electrode means to be maintained at a voltage level which is the same as said second predetermined voltage level set within said power supply means.

2. A system as defined in claim 1, wherein:

said single diode means comprises a high-voltage non-zener diode component reverse biased with a power supply voltage from said single power supply means.

3. A system as defined in claim 2, wherein:

the bias voltage on said single diode means is greater than the voltage upon the most highly discharged area of an image area being toned.

4. A system as defined in claim 2, wherein:

said development electrode means is connected to ground and has a variable capacitance; and said capacitance of said development electrode means to ground is controlled to a value which produces desired image characteristics.

5. A system as defined in claim 2, wherein an effective capacitor means is connected with said single diode means and is also connected to said development electrode means such that said effective capacitor means is charged to the diode bias voltage of said toning system.

6. A system as set forth in claim 1, wherein:

said first predetermined charging voltage level is greater than said second predetermined toning voltage level.

7. A system as set forth in claim 1, wherein:

the negative terminal of said power supply means is connected to the positive terminal of said diode means.

8. A system as set forth in claim 7, wherein:

the positive terminal of said power supply means is connected to ground.

9. A system as set forth in claim 7, wherein:

the negative terminal of said diode means is connected to said development electrode means.

10. A system as set forth in claim 1, wherein:

the negative terminal of said diode means is connected to said development electrode;

the negative terminal of said power supply means is connected to the positive terminal of said diode means; and the positive terminal of said power supply means is connected to ground.

11. A method of operating an electrophotographic copying machine and the like for use with electrophotographic materials wherein charging and toning take place at different times, said method comprising the steps of:

providing a corona-charging means;

providing a development electrode means;

connecting a single variably adjustable voltage D.C. power supply means to said development electrode means and said corona-charging means so as to supply a first predetermined corona-charging voltage level and a second predetermined toning voltage level; and connecting a single diode means in circuit with and between said development electrode means and said variably adjustable D.C. power supply means in such a manner as to prevent the passage of current from said power supply means to said development electrode means when said power supply means is set at said first predetermined corona charging voltage level so as to prohibit arcing between said development electrode means and said electrophotographic material, and for permitting the passage of current from said development electrode means to said power supply means when said power supply means is set at said second predetermined toning voltage level so as to permit said development electrode means to be maintained at a voltage level which is the same as said second predetermined voltage level set within said power supply means.

12. A method as recited in claim 11, said method further comprising:

providing, as said single diode means, a high-voltage non-zener diode component capable of being reverse-biased with a power supply voltage from said single power supply means.

13. A method as recited in claim 12, said method further comprising:

connecting an effective capacitor with said single diode means and said development electrode means such that said effective capacitor is charged to said diode bias voltage of the toning system of said machine.

14. A method as recited in claim 11, said method further comprising: providing a bias voltage on the said single diode means which is greater than the voltage on the most highly discharged area of an image member being toned.

15. A method as rectied in claim 11, wherein said development electrode means is connected to ground and has a variable capacitance, and said method further comprises:

controlling the capacitance of said development electrode means to ground to a value which produces desired image characteristics.

16. A method as set forth in claim 11, wherein:

said first predetermined charging voltage level is greater than said second predetermined toning voltage level.

17. A method as set forth in claim 11, wherein:

the negative terminal of said power supply means is connected to the positive terminal of said diode means.

18. A method as set forth in claim 17, wherein:

the positive terminal of said power supply means is connected to ground.

19. A method as set forth in claim 17, wherein:

the negative terminal of said diode means is connected to said development electrode means.

20. A method as set forth in claim 11, wherein:

the negative terminal of said diode means is connected to said development electrode;

the negative terminal of said power supply means is connected to the positive terminal of said diode means; and the positive terminal of said power supply means is connected to ground.

* * * * *